US007451052B2

(12) United States Patent
Wang et al.

(10) Patent No.: US 7,451,052 B2
(45) Date of Patent: Nov. 11, 2008

(54) APPLICATION OF COMPREHENSIVE CALIBRATION TO MASS SPECTRAL PEAK ANALYSIS AND MOLECULAR SCREENING

(75) Inventors: Yongdong Wang, Wilton, CT (US); Ming Gu, Yardley, PA (US)

(73) Assignee: Cerno Bioscience LLC, Danbury, CT (US)

( * ) Notice: Subject to any disclaimer, the term of this patent is extended or adjusted under 35 U.S.C. 154(b) by 308 days.

(21) Appl. No.: 11/444,158

(22) Filed: May 30, 2006

(65) Prior Publication Data

US 2007/0023633 A1 Feb. 1, 2007

Related U.S. Application Data

(60) Provisional application No. 60/685,129, filed on May 29, 2005.

(51) Int. Cl.
*H01J 49/00* (2006.01)

(52) U.S. Cl. ..... 702/85; 702/76

(58) Field of Classification Search ..... 702/85, 702/76, 23, 27; 250/282
See application file for complete search history.

(56) References Cited

U.S. PATENT DOCUMENTS 6,983,213 B2 * 1/2006 Wang ..... 702/85
2006/0217911 A1 * 9/2006 Wang ..... 702/85
2006/0255258 A1 * 11/2006 Wang et al. ..... 250/282
2007/0136017 A1 * 6/2007 Wang et al. ..... 702/85

* cited by examiner

*Primary Examiner*—Kiet T Nguyen
(74) *Attorney, Agent, or Firm*—David Aker

(57) ABSTRACT

A method of performing mass spectral analysis involving at least one of the isotope satellites of at least one ion, comprising acquiring a measured mass spectral response including at least one of the isotope satellites; constructing a peak component matrix with mass spectral response functions; performing a regression analysis between the acquired mass spectral response and the peak component matrix; and reporting one of statistical measure and regression coefficients from the regression analysis for at least one of mass spectral peak purity assessment, ion charge determination, mass spectral deconvolution, and mass shift compensation. A method for the identification of an ion in a sample through acquired MS scans, comprising obtaining an isotope pattern of an ion; constructing a projection matrix based on the isotope pattern or MS scan; projecting the isotope pattern or MS scan onto the projection matrix to calculate at least one of projection residual and projected data; and performing a statistical test on at least one of the projection residual and projected data to determine if the ion exists in the sample or if there is interference. A method which takes advantage of mass defect or isotope pattern analysis, and software and hardware for implementing all aspects of the invention.

91 Claims, 5 Drawing Sheets

Fig. 2A A Pure Peak
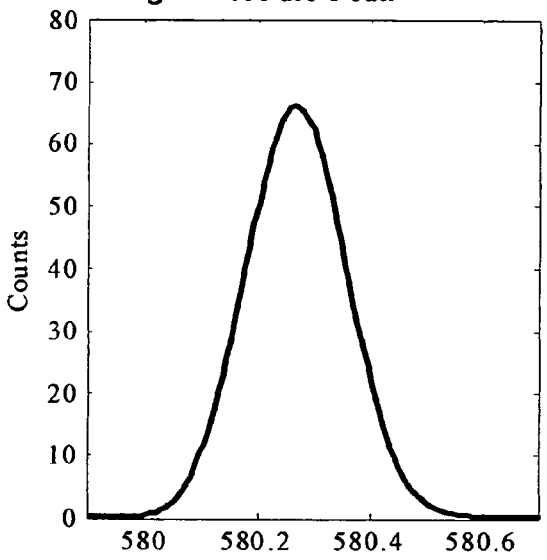
Fig. 2B
Fitting Residual: RMSE=0.17 Counts
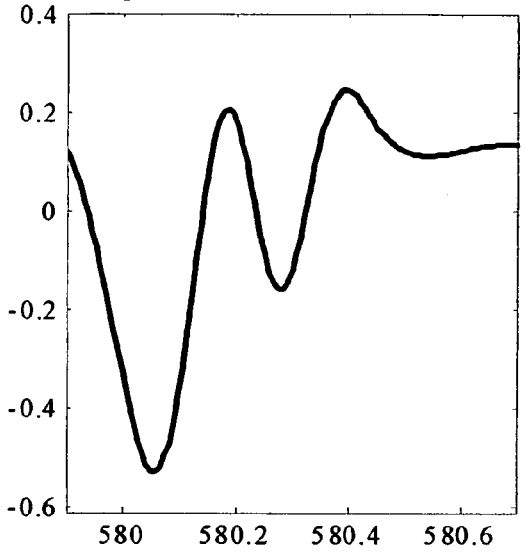
Fig. 2C A Peak w/Impurity
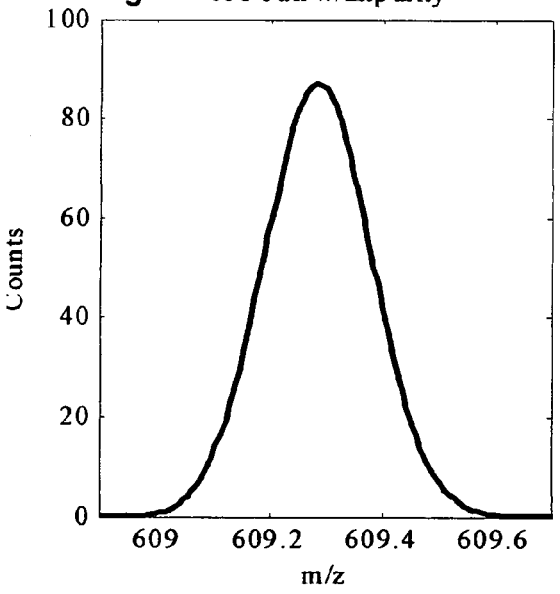
Fig. 2D
Fitting Residual: RMSE=0.47 Counts
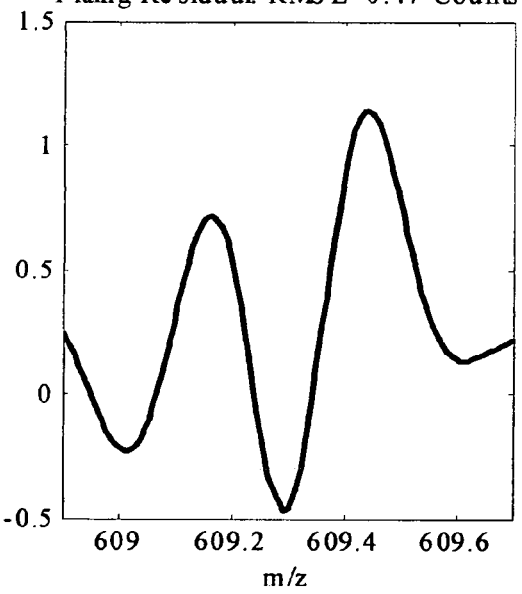

Fig. 3A Raw Mass Spectrum before Calibration
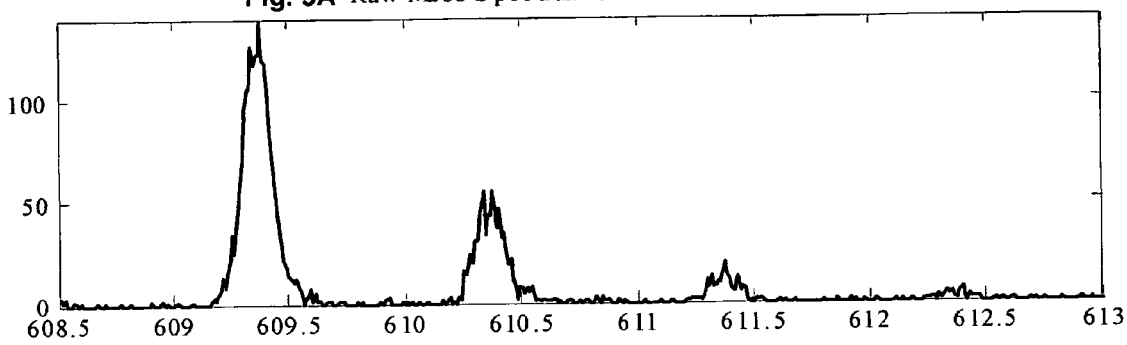
Fig. 3B Calibrated Mass Spectrum and Calculated Centroids
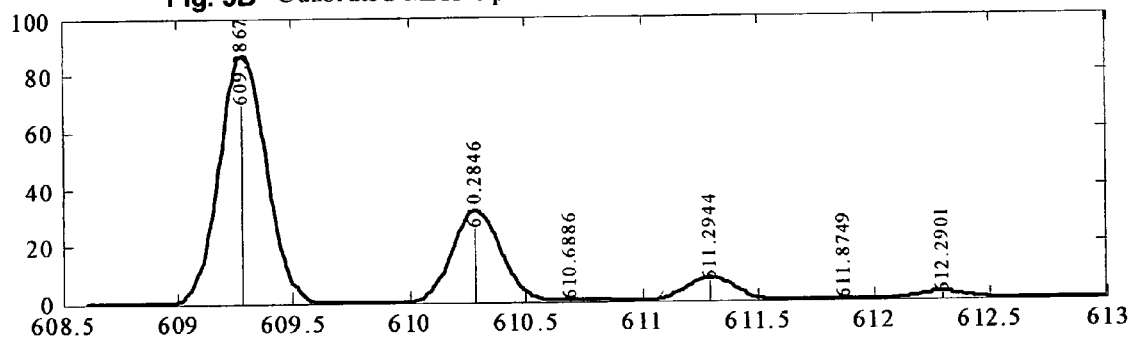
Fig. 3C Binned Isotope Distribution: Reserpine (solid -) and 8-Alanine (dashed --)
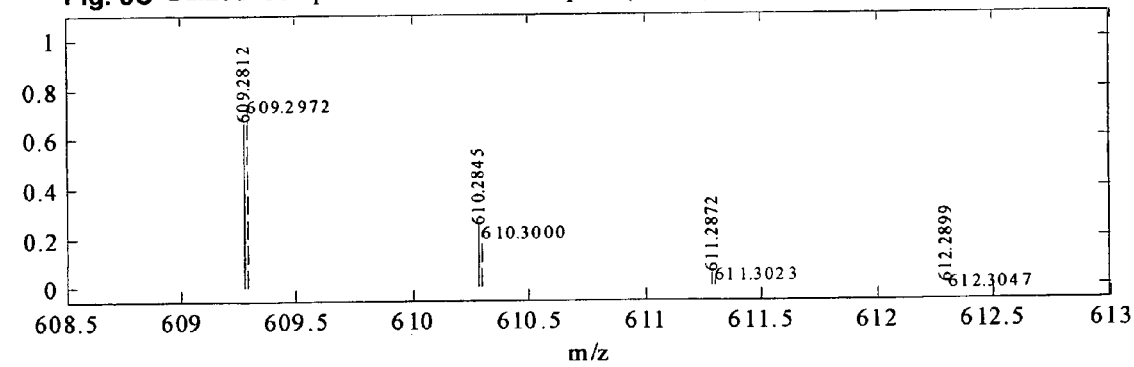

Calibrated & Fitted w/Reserpine

Fitting Residual w/Reserpine

Calibrated & Fitted w/8-Alanine

Fitting Residual w/8-Alanine

Calibrated & Fitted w/Reserpine&8-Alanine

Fitted Residual w/Reserpine & 8-Alanine

Fig. 5A Hirudin, z=4, FWHM=0.5Da
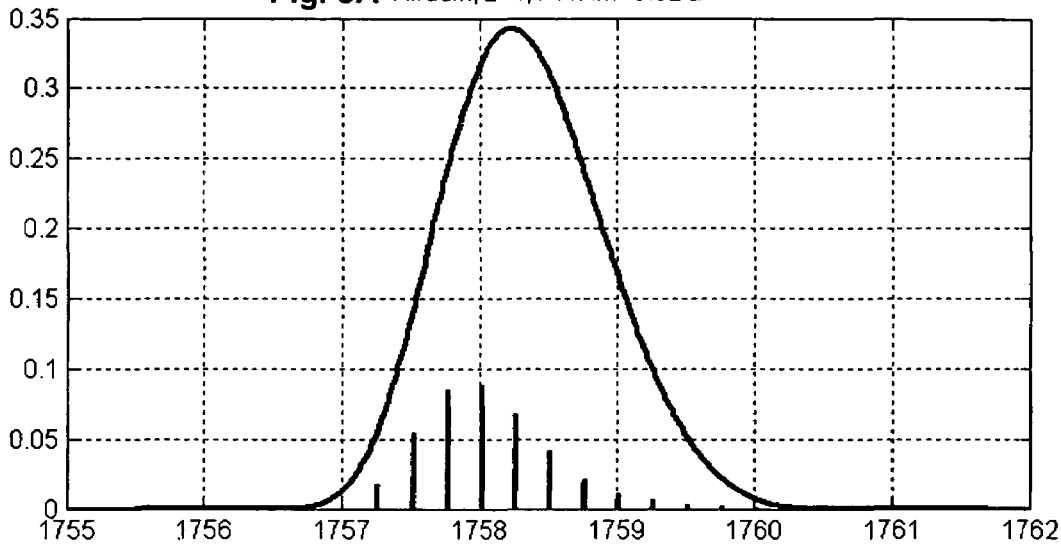
Fig. 5B Fitting Residual w/Derivative Correction
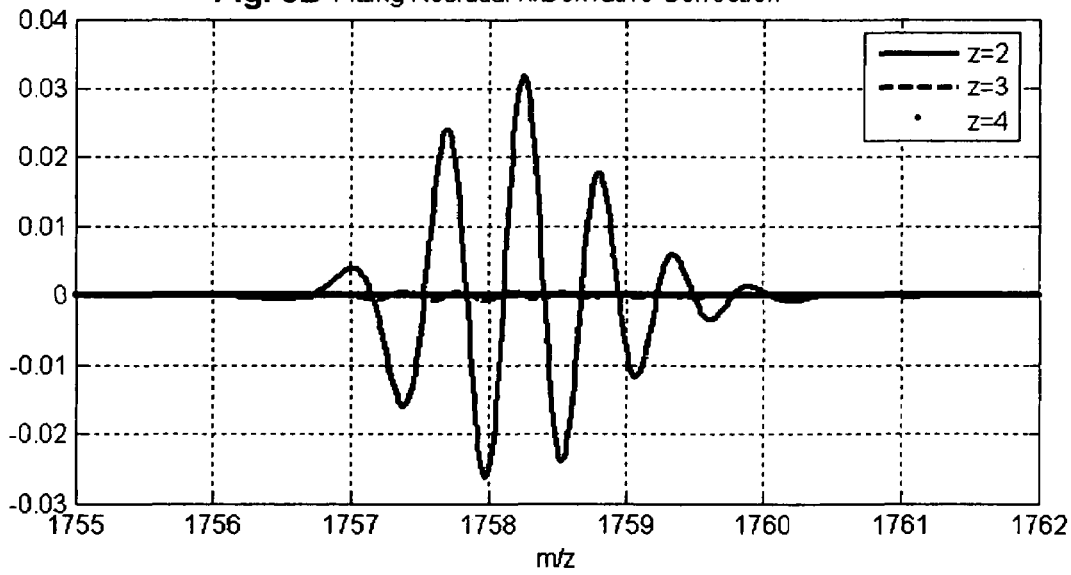

APPLICATION OF COMPREHENSIVE CALIBRATION TO MASS SPECTRAL PEAK ANALYSIS AND MOLECULAR SCREENING

This application claims priority under 35 U.S.C. 119(e) from U.S. provisional patent application Ser. No. 60/685,129, filed on May 29, 2005.

CROSS-REFERENCE TO RELATED APPLICATIONS

The following patent applications are related to this application. The entire teachings of these patent applications are hereby incorporated herein by reference, in their entireties.

U.S. Pat. No. 6,983,213 and International Patent PCT/US2004/034618 filed on Oct. 20, 2004 which claims priority therefrom.

U.S. Provisional patent applications 60/466,010; 60/466,011 and 60/466,012 all filed on Apr. 28, 2003, and International Patent Applications PCT/US2004/013096 and PCT/US04/013097 both filed on Apr. 28, 2004.

U.S. Provisional patent application Ser. No. 60/623,114 filed on Oct. 28, 2004 and International Patent Application PCT/US2005/039186, filed on Oct. 28, 2005.

U.S. provisional patent application Ser. No. 60/670,182 filed on Apr. 11, 2005; U.S. patent application Ser. No. 11/402,238 filed on Apr. 10, 2006, and International Patent Application PCT/US2006/013723 filed on Apr. 11, 2006, which claim priority therefrom, and designates the United States of America as an elected state.

BACKGROUND OF THE INVENTION

1. Field of the Invention

The present invention relates to mass spectrometry systems. More particularly, it relates to mass spectrometry systems that are useful for the analysis of complex mixtures of molecules, including large organic molecules such as proteins or peptides, environmental pollutants, pharmaceuticals and their metabolites, and petrochemical compounds, to methods of analysis used therein, and to a computer program product having computer code embodied therein for causing a computer, or a computer and a mass spectrometer in combination, to affect such analysis. Such mass spectrometry systems may also include ion mobility spectrometers which typically operates at ambient pressure without a vacuum pump typical of a mass spectrometer. The data acquired from IMS is typically called a plasmagram.

2. Background Art

Typical mass spectral data, acquired from either individual MS scans or averaged scans, contain rich information about the sample under study, including the molecular ions, fragment ions, adducts, the electrical charges, the concentrations, and the impurities (or co-eluting interferences from LC/MS or GC/MS experiments). It is highly desirable to determine from the mass spectral data the following information for small as well as large molecules:

The purity of a particular mass spectral peak.

If a mass spectral peak is deemed impure, the number of possible components contained in the peak and, furthermore, the elemental compositions related to each component.

Large biomolecules such as proteins or peptides, under electro-spray ionization (ESI), typically become multiply charged and become observable at low m/z ranges on a quadrupole mass spectrometer. Since the isotope distribution for these large molecules is relatively wide, covering quite a few mass units, the observed peak width for a particular molecule at a given charge is contributed to by both the isotope distribution and the intrinsic mass spectral peak width. Knowing the mass spectral peak width and determining the charge state for an observed mass spectral peak allows one to estimate the mass of the original large biomolecule, an important step in identifying key proteins or peptides for proteomics applications.

This task of peak purity determination and/or charge state determination has been quite a challenge due to the lack of dependable peak shape information through conventional mass spectral data processing, requiring user knowledge and human intuition for peak purity analysis and multiple observable peaks of consecutively varying charges for charge state determination.

Mass spectrometers, especially ion trap types of mass spectrometers, generally suffer from space charge effect, where mass spectral shift and possibly peak shape change occurs, thus limiting the mass accuracy achievable and usefulness for related applications, including mass spectral purity detection, charge determination, elemental composition determination, etc. While hardware solutions such as linear ion traps, 3D traps, and ion traps with larger internal volumes have been proposed, a software solution is preferred as it can benefit MS users of existing MS systems and further enhance the MS capabilities of newer designs.

Liquid chromatography interfaced with (tandem) mass spectrometry (LC/MS or LC/MS/MS) has been widely utilized for obtaining structural information of molecules such as the sequence of proteins and metabolic pathways of pharmaceuticals. To study a drug and its metabolites, the drug is typically injected into an animal model and biological fluids are taken from the animal model as samples for subsequent sample preparation, such as extraction and LC/MS analysis. The drug and its metabolites are separated in time and then detected with mass spectrometry. To search for a particular molecule, either the drug itself or its possible metabolites, the user would go through a post-analysis process to extract ion chromatograms in a limited m/z window. For verapamil ($C_{27}H_{39}N_2O_4^+$, monoisotopic mass 455.2910 Da), for example, the drug itself can be seen in an extracted ion chromatogram in the m/z range of 454.8 and 455.8. This approach suffers from several drawbacks:

1. On conventional unit mass resolution systems, the mass spectral centroiding process can rarely provide better than 0.1 Da in mass accuracy, necessitating ion integration in a large mass window such as +/−0.5 Da.
2. While such large mass window has the potential advantages of getting more ions integrated with better signal-to-noise, it at the same time opens up the window for unwanted ions from background and matrices, complicating the extracted ion chromatogram and its interpretation.
3. Even on higher resolution MS systems where one could afford to narrow the integration window due to the narrower peak width and higher mass accuracy achievable, such ion extraction process is prone to errors caused by including the isotope ions of other ions. In the above example, the M+1 isotope cluster from another ion at 454.291 will show up in the m/z window of verapamil and be included as the ion of interest.

Due to these complications, LC/MS data processing and interpretation typically takes longer than the LC/MS experiment itself, in spite of an apparently complicated multi-step process involved in acquiring the data through sample preparation, LC separation and MS analysis. The presence of biological matrices such as bile, feces and urine further complicates the analysis due to the many background ions these matrices generate. There are currently two approaches to address the issue of complex matrices:

Use a higher resolution system such as qTOF where the higher resolution and better mass accuracy can lead to better separation and differentiation between the ions of interest and those coming from the background matrices.

Perform further MS analysis through MS/MS experiments that offer a variety of structurally specific information to facilitate identification of metabolites and proteins/peptides in the presence of biological matrices.

MS/MS experiments in general require two mass analyzers and a collision cell filled with collision gas such as Argon. The combination of scan functions from each of the two mass analyzers results in three different MS/MS modes. One aspect of the design of MS/MS experiments is the selection of the three MS/MS operational modes currently available for qualitative analysis:

1. Product ion scan. This is the most commonly used MS/MS experiment for structural elucidation. Its experimental process includes the selection of precursor ions by one mass analyzer, collision-induced dissociation (CID) of the precursor ions in the collision cell, and scanning of the fragment ions by another mass analyzer. This scan mode can be performed in all the instruments that have two mass analyzers such as triple stage quadrupole (TSQ), ion trap, quadrupole/time of flight (qTOF), Fourier Transform mass spectrometer (FTMS), and Time-Of-Flight/Time-Of-Flight (TOF/TOF).
2. Neutral loss scan. This scanning function is currently available only in a TSQ instrument. By scanning two quadrupoles at the same time with a mass offset equal to the mass of lost neutrals during CID, this method detects only those ions that lost a specific functional group and is useful for target analysis.
3. Precursor ion scan. This is another scanning function available only in a TSQ instrument for target analysis based on a specific fragment ion. With the first mass analyzer scanning in a certain mass range, the second mass analyzer is set to detect the specific ions generated by CID.

Another aspect of the design of MS/MS experiments is how to execute the MS/MS experiments during an LC separation. Early LC/MS/MS data acquisition required a pre-run to determine the retention time and the m/z value of the precursor ions of interest to define the time window for MS/MS on the precursor ions and to set up MS/MS conditions such as mass scan range and collision energy, respectively. This inefficient and hardly automated data collection procedure quickly prompted the development of data dependent acquisition or information dependent acquisition. Data dependent acquisition is an intelligent way to perform MS/MS on-the-fly without the knowledge of retention time and the m/z value of the precursor ions. It starts with a survey scan (usually a full MS scan), to calculate the intensities of the most abundant ions and their signal-to-noise ratios for decision-making by the data acquisition system. If ion intensities and/or signal-to-noise ratios exceed a pre-defined threshold, the acquisition will be triggered to switch from full MS scan to product ion scan. After the MS/MS, data collection continues to perform a full MS scan until the intensities and/or signal-to-noise ratios are above the threshold to trigger the MS/MS again. This cycle from full MS to MS/MS usually repeats itself through an entire LC run.

Data dependent acquisition can also use the neutral loss scan or the precursor scan as the survey scan to achieve more specificity. For example, when the ions losing particular neutrals during CID are determined to be of interest, the neutral loss scan is employed to find those ions. As soon as a signal is detected by the neutral loss scan with sufficient intensity and/or signal-to-noise ratio (above a preset threshold), the data acquisition will switch from the neutral loss scan to product ion scan. This powerful combination provides high specificity by neutral loss or precursor scan and detailed structural information by product ion scan, all in one experiment.

Over the past 10 years or so, data dependent acquisition has increasingly gained great popularity for high throughput applications such as metabolic profiling and proteomics applications. However, due to the highly non-specific criteria, namely, the ion intensities and signal to noise ratios, used to trigger MS/MS experiments in the data dependent acquisition, MS/MS spectra are generated not only from the ions of interest such as metabolites in metabolic profiling applications, but also from the ions of the matrix or the background. This poses a challenging problem for automated post-acquisition data processing. Moreover, when the ions of interest co-elute with, and are less abundant than the background or matrix ions, the ions of interest will be skipped while the background or matrix ions are selected for the product ion scan.

SUMMARY OF THE INVENTION

It is an object of the invention to provide a method, apparatus and computer software product for assessing the purity of data giving rise to a mass spectral peak.

It is a further object of the invention to provide a method, apparatus and computer software product for efficiently deconvoluting mass spectral data including data from spurious ions not of general interest.

It is another object of the invention to provide method, apparatus and computer software product for accurately determining the charge state and therefore the masses of ions of interest.

It is yet another object of the invention to provide a method, apparatus and computer software product for accurate identification of an ion from LC/MS scans.

It is an additional object of the invention to provide a method, apparatus and computer software product to facilitate performing mass defect dependent MS/MS.

It is a another object of the invention to provide a method, apparatus and computer software product to facilitate performing accurate mass and isotope pattern dependent MS/MS.

These objects and others are achieved in accordance with the invention by a departure from conventional MS, GC/MS, LC/MS, and LC/MS/MS analysis procedures that require centroiding the mass spectral profile mode data into stick spectrum without a comprehensive mass spectral calibration, a process prone to error and subject to many empirical parameter settings that causes the loss of significant and critical information.

The comprehensive mass spectral calibration process disclosed in U.S. Pat. No. 6,983,213 and International Patent PCT/US2004/034618 filed on Oct. 20, 2004 first transforms the raw continuum mass spectral data into fully calibrated mass spectral continuum data with accurate mass and mathematically defined mass spectral peak shape functions, achieving noise filtering while retaining all the important mass spectral information. In accordance with the present invention, further data analysis based on such fully calibrated mass spectral data leads to the following novel approaches:

1. A novel approach for MS peak purity assessment, charge determination, and component identification.
2. A novel approach to analyze LC/MS data with high molecular fidelity for metabolism study or protein/peptide analysis while rejecting the ions from background or matrices, even on conventional unit mass resolution LC/MS systems.
3. A novel approach to accurately decide on MS/MS experimentation on-the-fly to insure that the ions of interest are always included for MS/MS analysis while ignoring the often abundant ions from the background or matrices, even on conventional unit mass resolution LC/MS systems.

A first aspect of the invention is directed to a method of performing mass spectral analysis involving at least one of the isotope satellites of at least one ion, comprising acquiring a measured mass spectral response including at least one isotope; constructing a peak component matrix with mass spectral response functions; performing a regression analysis between the acquired mass spectral response and the peak component matrix; and reporting one of statistical measure and regression coefficients from the regression analysis for at least one of mass spectral peak purity assessment, ion charge determination, mass spectral deconvolution, and mass shift compensation. The method can further comprise defining desired mass spectral response functions.

The desired mass spectral response function is advantageously a mass spectral peak shape function. The mass spectral peak shape function can be one of assumed peak shape function, actual peak shape function, and target peak shape function. the mass spectral peak shape function can be assumed peak shape function that approximates the actual peak shape function. If the mass spectral peak shape function is actual peak shape function, it can be one of calculated and measured peak shape function from a mass spectral scan. The mass spectral peak shape function can be target peak shape function from a mass spectral calibration involving at least one of mass and peak shape. The desired mass spectral response function can contain a convolution of isotope distribution and mass spectral peak shape function for at least one isotope of an ion isotope distribution can be based on one of calculated theoretical distribution based on an elemental composition, and actually measured isotope distribution.

The peak component matrix can contain at least one of desired mass spectral response function of at least one isotope of an ion, baseline components, derivative components, background components, and the desired mass spectral response functions of at least one isotope of an additional ion. The baseline components can be at least one of linear and nonlinear in nature. The derivative components can be first derivatives of at least one of acquired mass spectral response functions and desired mass spectral response of at least one isotope of one ion. The background components can be taken from another mass spectral scan.

The desired mass spectral response functions are one of theoretically calculated based on proposed elemental compositions and actually measured. The regression analysis can be a weighted least squares regression. The weighted least squares regression can be a linear regression which is one of univariate and multivariate. The weights in the weighted least squares regression can be inversely proportional to the mass spectral variances. Mass spectral variances can be proportional to mass spectral intensities. The regression coefficients contain concentration information for the ions of interest. The statistical measure can be one of a t-statistic, F-statistic, $\chi^2$ statistic, and p-value, and can be used to indicate whether the acquired mass spectral response is from a single ion. The statistical measure can be used to indicate possible charge states of one or more ions contained in the acquired mass spectral response. The acquired mass spectral response can be calibrated for at least one of mass and peak shape. The mass spectral response is a plasmagram acquired on an ion mobility spectrometer.

The invention is also directed to a method for the identification of an ion in a MS scan, comprising obtaining at least one isotope pattern of an ion; acquiring at least one MS scan covering a mass range of interest; constructing a projection matrix based on one of the isotope pattern and the MS scan; projecting at least one of the isotope patterns onto the projection matrix to calculate at least one of projection residual and projected data; and performing a statistical test on at least one of the projection residual and projected data to determine one of if the ion exists in the sample and if the acquired MS scan contains an interference. The isotope pattern can be calculated by steps comprising one of calculating isotope distribution for a given ion of interest based on elemental composition and measuring isotope distribution for a given ion of interest; and convoluting the isotope distribution with one of assumed peak shape function, actual peak shape function, and target peak shape function to form the isotope pattern. The method can further comprise applying a weighting scheme based on a projection statistical measure to filter an extracted ion chromatogram in order to enhance signals relevant to an ion of interest and suppress signals not relevant to the ion of interest.

The extracted ion chromatogram used for filtering can be based on one of summed mass spectral intensities within a mass range and fitted quantities using a theoretical isotope pattern for the ion of interest. The he projection statistical measure can be one of a t-statistic, F-statistic, $\chi^2$ statistic, and p-value. The projection matrix can be calculated based on Singular Value Decomposition (SVD) of the submatrix. The method can further comprise plotting the projected data against MS scan time to obtain an extracted ion chromatogram with reduced interference.

The method can further comprise using a front end separation step; and conducting multiple mass spectral scans corresponding to multiple time points of the front end separation step. The front end separation step can include a chromatographic separation, which can be one of liquid chromatography (LC) or gas chromatography (GC).

A given ion of interest can be a defined mixture of ions with known elemental compositions. The mixture can be defined by concentration ratios of ions contained therein. The ions can include native and isotope labeled version of the same ion.

The acquired MS scan can be calibrated for at least one of mass and peak shape. The mass spectral response can be a plasmagram acquired on an ion mobility spectrometer.

Another aspect of the invention is directed to a method for integrating mass defects detection into mass spectral data acquisition, comprising specifying a mass defect criterion based on mass defects for ions of interest; acquiring a full mass spectral scan; computing mass defects of all ions in the full mass spectral scan; and performing an MS/MS experiment on the ions that have met a pre-defined mass defect criterion. The mass defect can be computed by accurate mass measurement of all ions from a fill MS scan. The accurate mass measurement can be achieved on a mass spectrometer of resolving power higher than unit mass resolution, or on a mass spectrometer of substantially unit mass resolution through a mass spectral calibration involving at least one of mass and peak shape. The computing step can be carried out in real time during an active data acquisition process on a mass spectrometer.

In accordance with yet another aspect, the invention is directed to a method for performing mass and isotope pattern dependent MS/MS, comprising defining a list of possible ions including their elemental compositions; calculating theoretical isotope distributions for ions in the list; convoluting the theoretical isotope distributions with one of assumed peak shape function, actual peak shape function, and target peak shape function to form theoretical isotope patterns; acquiring a full mass spectral scan in profile mode; analyzing the full mass spectral scan for both masses and isotope patterns; and identifying ions with the correct masses and matching isotope patterns for MS/MS analysis. The analyzing and identifying can be accomplished through a regression analysis between the theoretical isotope patterns and measured isotope patterns in the acquired full mass spectral scan in profile mode. The analyzing and identifying also can be accomplished through a projection operation involving the theoretical isotope patterns and the acquired full mass spectral scan in profile mode.

The method can further comprise calibrating the acquired full mass spectral scan in profile mode using a calibration involving at least one of mass and peak shape.

The assumed peak shape function can be used for convolution and can approximate the true peak shape function. The actual peak shape function can use for convolution and can be one of actually measured and calculated from mass spectral scan data. The target peak shape function can be used for convolution and can be based on a mass spectral calibration involving at least one of mass and peak shape.

Each ion in the list can be one of a defined mixture of ions with known elemental compositions. The mixture is defined by concentration ratios of the ions. The ions can include native and isotope labeled version of the same ion.

The acquiring, analyzing, and identifying can be carried out in real time during an active data acquisition process on a mass spectrometer.

In according with yet another aspect, the invention is directed to a method of performing mass spectral analysis in the presence of mass shift involving at least one of the isotope satellites of at least one ion. The method comprises acquiring a measured mass spectral response including at least one isotope; obtaining a desired mass spectral response including at least one isotope; comparing the measured mass spectral response and the desired mass spectral response and calculating a goodness-of-fit measure and relative concentration between the measured and desired mass spectral response; repeating the comparing step by shifting one of the measured and desired mass spectral response to seek an optimal mass shift that provides the best goodness-of-fit measure; and using at least one of the optimal mass shift, the corresponding goodness-of-fit, and the relative concentration for one of quantitative and qualitative analysis.

The desired mass spectral response function can contain a convolution of isotope distribution and mass spectral peak shape function for at least one isotope of an ion.

The isotope distribution can be based on one of calculated theoretical distribution based on an elemental composition, and actually measured isotope distribution.

The mass spectral peak shape function can be one of assumed peak shape function, actual peak shape function, and target peak shape function. The mass spectral peak shape function can be assumed peak shape function and can approximate the actual peak shape function. The mass spectral peak shape function can be actual peak shape function that is one of calculated and measured peak shape function from a mass spectral scan. The mass spectral peak shape function can be target peak shape function and can be based on a mass spectral calibration involving at least one of mass and peak shape.

The invention is also directed to at least one computer programmed to perform one or more of the methods described above. The computer can be combined with a mass spectrometer for obtaining mass spectral data to be analyzed by the computer. The invention is also directed to a computer readable medium having computer readable code thereon for causing a computer to perform one or more of the methods described above. A mass spectrometer can have associated therewith a computer for performing data analysis functions of data produced by the mass spectrometer, the computer performing one or more of the methods described above.

Each of these areas and respective aspects will be described below along with some preliminary results to demonstrate their utilities.

BRIEF DESCRIPTION OF THE DRAWINGS

The foregoing aspects and other features of the present invention are explained in the following description, taken in connection with the accompanying drawings, wherein:

FIGS. 2A, 2B, 2C and 2D are graphs illustrating peak purity determination: a pure peak (in FIG. 2A) with its corresponding small fitting residual (FIG. 2B) and an impure peak (FIG. 2C) with its corresponding larger fitting residual (FIG. 2D).

FIGS. 3A-3C contain graphs of a raw mass spectral scan (FIG. 3A), fully calibration scan (FIG. 3B) with the peak centroiding overlaid, and reserpine and 8-alanine isotopes as two possible candidates (in FIG. 3C) contributing to the observed mass spectra shown in FIGS. 3A and 3B.

FIG. 5A contains the graph for Hirudin isotope distribution and the observed isotope cluster at unit mass resolution (FWHM=0.5 Da) and FIG. 5B the fitting residuals with different trial charges.

DETAILED DESCRIPTION OF THE PREFERRED EMBODIMENTS

Figure 1:
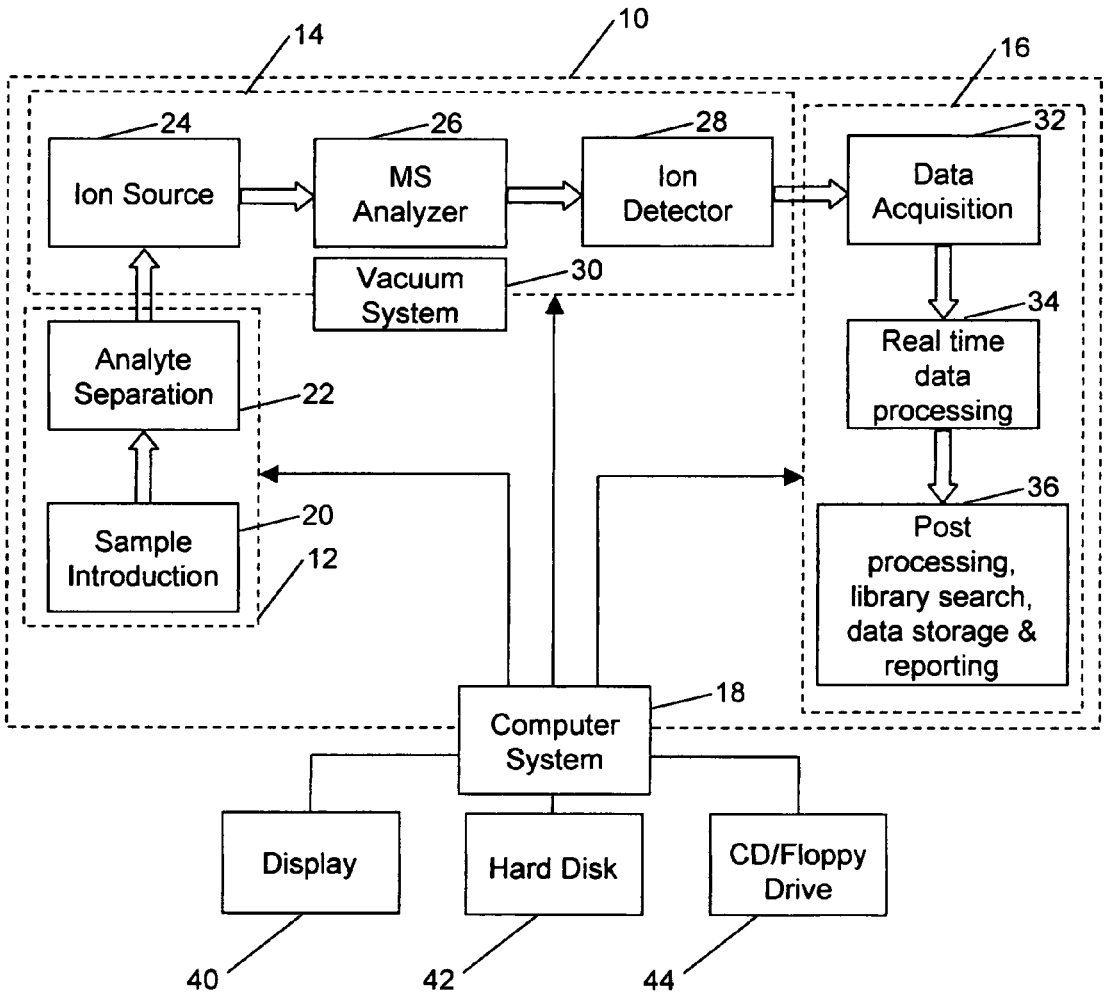
FIG. 1 is a block diagram of an analysis system in accordance with the invention, including a mass spectrometer and optionally a front end separation process such as an LC system.

The operation of an analysis system, including a mass spectrometer, in which the present invention may be used, as illustrated in FIG. 1, is set forth in detail in International Patent Application PCT/US2004/034618 filed on Oct. 20, 2004 and International Patent Applications PCT/US04/013096 and PCT/US2004/013097 both filed on Apr. 28, 2004.

As pointed out in U.S. Pat. No. 6,983,213, International Patent Application PCT/US2004/034618 filed on Oct. 20, 2004 and International Patent Applications PCT/US2004/013096 and PCT/US2004/013097 both filed on Apr. 28, 2004, the fully calibrated mass spectral continuum data preserves the data integrity and key mass spectral information for further data processing and hypothesis testing. A few of these further aspects and applications will be described in detail along with results for their preliminary applications.

Peak Purity Assessment:

When an actual mass spectral peak has been fully calibrated, its peak width and peak shape is fully defined to within the measurement noise level, with only its peak position and peak intensity as unknowns, which can be determined in a computationally efficient manner, without any assumptions concerning peak parameters, using the peak analysis approach disclosed in the above mentioned earlier filings. As a by-product of this peak analysis process, a fitting residual can be calculated which can serve as a very good indicator for peak purity, i.e., the fitting residual will be at the noise level when the peak is indeed composed of a single peak component from the monoisotopic peak of a single ion or from one of its other isotopes with closely located isobars. When the peak is not pure with contamination from other ions of significantly different m/z values, the fitting residual will be large compared to the random noise in the data.

FIG. 2A shows a pure peak after the above mentioned full calibration with the corresponding fitting residual shown in FIG. 2B. FIG. 2C shows a peak with impurity contribution from another peak located only 0.016 Da away with an amplified residual shown in FIG. 2D. The fitted residual as measured by Root-Mean Squared Error (RMSE) goes up by close to a factor of 3 from 0.17 to 0.47 counts, a very sensitive detection scheme for peak purity.

Spectral Deconvolution

Figure 4A:
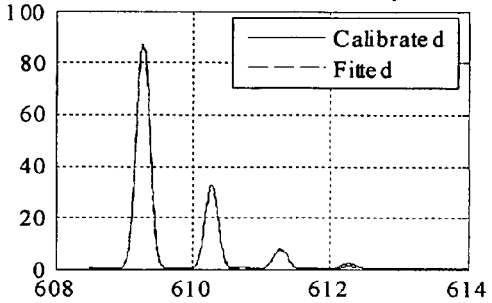
FIGS. 4A-4F contain graphs of the calibrated mass spectrum overlaid with fitted mass spectra using reserpine (FIG. 4A), 8-alanine (FIG. 4C), and both (FIG. 4E) with the corresponding fitting residuals shown in FIGS. 4B, 4D, and 4F, respectively.
Figure 4B:
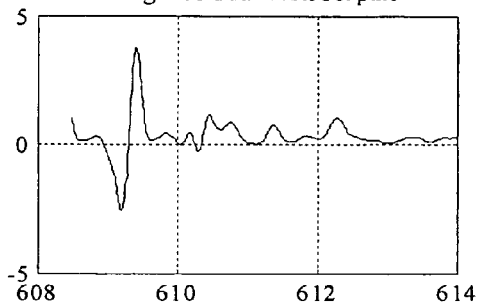
Figure 4C:
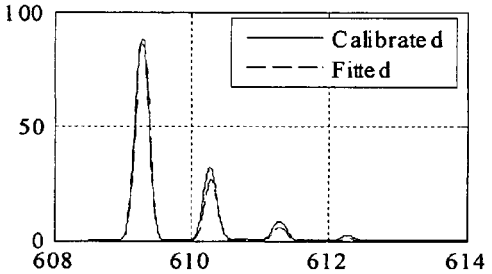
Figure 4D:
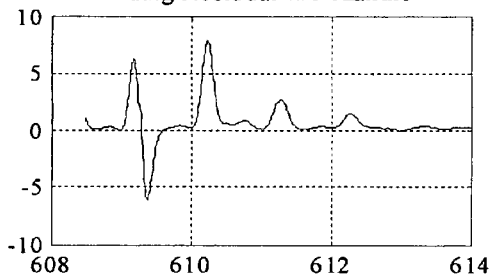
Figure 4E:
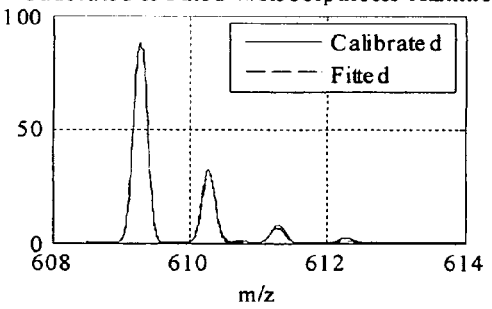
Figure 4F:
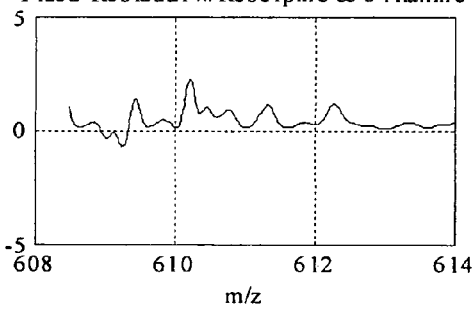

The above peak purity assessment scheme can be expanded to the whole isotope cluster including other satellite isotopes of the same ion. FIG. 3A is one such section of a mass spectral scan before the comprehensive calibration, which resembles an ordinary isotope cluster. Several steps will be taken to examine and deconvolute this spectrum into its proper components:

1. Perform the comprehensive mass spectral calibration on raw mass spectral continuum shown in FIG. 3A to obtain a fully calibrated spectrum in FIG. 3B.
2. Accurately analyze the peaks both in terms of peak areas and mass locations. The monoisotopic mass reported, 609.2867 Da shown in FIG. 3B, seems too far from what is expected at 609.2972 Da for the 8-alanine ion, indicating the existence of possible impurities.
3. The isotope distribution for 8-alanine is calculated and convoluted with the target peak shape function specified during the calibration to form the theoretical isotope cluster for 8-analine.
4. A search for monoisotopic mass in a small mass range reveals one candidate for possible contamination, Reserpine, with its monoisotopic mass at 609.2812 Da. A theoretical isotope cluster for Reserpine is similarly calculated.
5. Each of the Reserpine and 8-analine isotope clusters is fitted to the calibrated mass spectrum shown in FIG. 3B, along with any lower or higher order baseline components necessary, in an ordinary or weighted least squares fit, to yield fitted mass spectrum/fitting residual shown in FIG. 4A/FIG. 4B and FIG. 4C/FIG. 4D, respectively.
6. Statistical testing of the residuals shown in FIGS. 4B and 4D shows significant error of a systematic nature, indicating neither one of the two components provides a sufficient fit to the observed mass spectrum.
7. Combining Reserpine and 8-alanine into a multiple linear regression yields a fitted mass spectrum (FIG. 4E) with statistically insignificant fitting residual (FIG. 4F).
8. The relative contributions from Reserpine and 8-analine are also obtained as part of the multiple linear regression fit along with other statistical measures such as t-values, p-values, F-values, or confidence intervals, etc.

Charge Determination

Large biomolecules with molecular weight over several thousand Dalton up to 500,000 Da, typically have many sites on the molecule that could be simultaneously ionized during the electrospray ionization (ESI) process to produce molecular ions with many charges (large z values) and therefore much smaller m/z values, allowing these large molecules to be observed at the lower end of the m/z scale typically available on even conventional quadrupole MS systems.

FIG. 5A shows the isotope distribution of Hirudin (MW=7033, $C_{289}H_{446}N_{84}O_{109}S_6$) with 4 charges (z=4) making itself observable at m/z=1758 Da on a unit mass resolution (FWHM=0.5 Da) MS instrument. Its many isotopes (shown as bars in FIG. 5A), however, overlap and are not distinguishable at such resolution, and only one overall peak is observed. This peak is not a single pure peak, using the peak purity assessment scheme outlined above. However, it can be mathematically modeled as a linear combination of a few equally spaced known peak shape functions, which are fully defined as a result of the comprehensive calibration performed, $$r=Kc+e \qquad \text{Equation. 1}$$

where r is an (n×1) matrix of the profile mode mass spectral data sampled at n m/z points, for example, the solid curve shown in FIG. 5A; c is a (p×1) matrix of regression coefficients which are representative of the concentrations of p components contained in this peak; K is an (n×p) matrix composed of equally spaced peak shape functions sampled at n m/z points; and e is an (n×1) matrix of fitting residual with contributions from random noise and any systematic deviations from this model. The m/z spacing of the peak shape functions in K is given by 1/z, or the inverse of charge state z as the 1 Da nominal spacing between each isobar cluster in an isotope distribution is reduced to 1/z on the m/z axis. These components arranged in the matrix K will be referred to as peak components, which may optionally include any baseline of known functionality such as a column of 1's for a flat baseline or an arithmetic series for a sloping baseline.

To compensate for any overall shift between the peak components and the observed response r, a first derivative of r or, alternatively, of relevant components in peak components in K, can be optionally added to the peak component matrix K to compensate for any mass shift caused by, for example, the space charge effects mentioned earlier. This same accommodation can be added for peak purity detection, charge determination, mass spectral deconvolution, and general mass spectral analysis to provide an economical and computationally effective approach to compensate for mass shift effect caused by instrumental or experimental factors such as space charge in the ion source, collision cell, ion trap, Ion Cyclone Resonance (ICR) cell, and other parts of mass spectral hardware. Other computationally less efficient approaches and algorithms may also be utilized, such as linear and nonlinear searches for optimal mass shift determination through iteratively varying the mass shift with residual errors e in Equation 1 as the objective function.

For any given z, the above equation can be solved via ordinary least squares regression or weighted least squares regression where the weights are inversely proportional to the mass spectral variances at m/z sampling points, which are automatically available as part of the comprehensive mass spectral calibration of r, based on the earlier filings. As the value of z increases from 1 to higher numbers, the fitting residual will decrease until it reaches the noise level, where the minimum charge state z can be established (FIG. 5B). The reason that the charge state z thus determined is only a minimum is due to the limited instrument resolution in this case. As the spacing between peak components, 1/z, gets smaller and smaller, the peak components in K becomes more and more collinear, allowing them to fit the data r better and better in terms of residual, until even the noise becomes part of the fit (overfitting). One way to prevent this from happening is to use an instrument of higher resolution for molecules of higher molecular weights and higher charge states, as the narrower peak widths from a higher resolution instrument will improve the conditioning of the K matrix and allow for more peak components to be included without the risk of collinearity or overfitting, so that a more accurate estimation on the charge state z can be obtained. In the case given in FIG. 5A, the charge state z can be determined to be at least 3, judging by the residual in FIG. 5B.

Identification of a Known Ion from LC/MS or GC/MS or other MS Scans with Front End Separation A novel approach is disclosed here to allow for accurate identification of a known ion from LC/MS experiments, by performing the identification through advanced mathematical processing with high mass accuracy and using all observable isotopes from the ion and in the presence of co-eluting ions from background and matrices. The specific steps involved include:

1. For a given ion of interest, for example, the drug verapamil ($C_{27}H_{39}N_2O_4^+$) or its demethylation metabolite ($C_{26}H_{37}N_2O_4^+$), calculate its theoretical isotope distribution based on the elemental compositions. In the presence of isotope labeling, properly modified elemental compositions will be used, for example, $C_{26}{}^{14}CH_{39}N_2O_4^+$and $C_{25}{}^{14}CH_{37}N_2O_4^+$for the radio labeled version of verapamil and its demethylation metabolite. In some metabolism studies, it may be advantageous to experiment with a mixture of the native and radio labeled version of the compounds to take advantage of the high selectivity from available Radio Activity Monitor (RAM) and the unique mass spectral pattern generated by such a mixture. For example, the 1:1 mixture of the native demethylation metabolite $C_{26}H_{37}N_2O_4^+$and its radio labeled version $C_{25}{}^{14}CH_{37}N_2O_4^+$show strong peaks at two nearby mass locations: one at monoisotope mass of 441.2753 Da and the other at the M+2 mass of 443.2786 Da. For such a mixture, the individual isotope distributions can be numerically combined with the given ratio into a mixture theoretical distribution.
2. Convolute the theoretical isotope distribution with the known peak shape function for the LC/MS experiment to produce vector r (n-by-1 matrix) sampled at n m/z points. This known peak shape function comes from an assumed peak shape function, an actual measured peak shape function as measured or calculated, or the target peak shape function from a comprehensive mass spectral calibration performed on the data using the approach disclosed in U.S. Pat. No. 6,983,123. It should be noted that when some of the ions are known in an LC/MS experiment from either the sample or its background or matrices, it is possible to perform a nearly internal calibration for the very LC/MS run itself, by using these known ions as calibration standards.
3. Perform the necessary comprehensive mass spectral calibration for each MS scan in the entire LC/MS data set or on the MS scans in a limited mass range of interest covering the same range as the vector r above.
4. Select a submatrix K from the fully calibrated LC/MS matrix by selecting the columns or rows corresponding to the same mass range covered by r and a retention time range of interest. Arrange the submatrix K as an m-by-n matrix where m is the number of retention time points selected.
5. Perform a Singular Value Decomposition (SVD) on the matrix K and select a few significant principal components to approximate K with residual matrix E:

$$K=USV^T+E$$

Note that by selecting a number of significant components to include in the reconstruction of K, other interfering ions including background and matrices have now been implicitly accounted for and automatically modeled, providing a significant advantage over other approaches that require explicit modeling of these components, as one is not required to identify these interfering components for implicit modeling.

6. Construct a projection matrix P through an identity matrix I dimensioned n-by-n:

$$P=I-VV^T$$

7. Project the known ion mass spectral response vector r onto this projection matrix and calculate a projection residual e representing the part of r that does not belong to the mass spectral space given by submatrix K:

$$e=r^TP$$

8. Perform statistical test on the residual e to determine if this ion belongs to the subspace spanned by the measured LC/MS response K: if the residual e is significant, this ion does not exist in the sample, given the experiment and the submatrix K; alternatively, if the residual e is insignificant, this ion does exist in the sample, given the experiment and the submatrix K. Statistical significance such as p-value can be established as a metric for a conclusion concerning the presence or absence. Available statistical tests, including well established t-statistic, F-statistic, and $\chi^2$ statistic may be used.
9. Weighting schemes designed based on the residual or the p-value can be applied to extracted ion chromatograms to enhance the signals relevant to the ion of interest and suppress signals not relevant to the ion of interest. The extracted ion chromatogram can either be a conventional extracted Ion Chromatogram (XIC) or one calculated from the entire isotope pattern, such as the one disclosed in U.S. provisional patent application Ser. No. 60/670,182 filed on Apr. 11, 2005; and U.S. patent application Ser. No. 11/402,238 filed on Apr. 10, 2006.
10. As an alternative to step 6, a different projection matrix P can be constructed without the use of an identity matrix I:

$$P=VV^T$$

so that any test vector r can be projected into P to arrive at the part of r that belongs to the subspace spanned by the submatrix K (called projected signal):

$$s=r^TP$$

which can now be subjected to a statistical test to compare to noise level in the data. If s is significantly above noise, there is significant presence of this ion in the retention time and mass window selected for the submatrix K; conversely, if s is not significant compared to noise, there is no significant presence of this ion in the selected time and mass window.

11. The elements in the projected signal s from step 10 can be plotted against the corresponding retention times in the submatrix K to obtain a filtered extracted ion chromatogram. This filtered extracted ion chromatogram should be reasonably free of interferences from the background or matrices.

Mass Defects Dependent MS/MS

This aspect of the invention employs mass defects to trigger an instrument to perform product ion scan MS/MS experiments. Mass defect of a molecule, defined as the difference between its nominal mass and mono-isotope mass, has been used to design a mass defect filter to simplify post-acquisition data processing for metabolite identification applications (Haiying Zhang et al, Proceedings of the 51st ASMS Conference on Mass Spectrometry and Allied Topics, Montreal, Quebec, Canada, Jun. 8-12, 2003, Haiying Zhang et al, J. Mass Spectrom. 2003; 38, 1110-1112, and U.S. Patent Application 2005/0272168). The approach assumes that the mass defects of a drug molecule and its phase I and phase II metabolites all fall within about a 50 mDa window. Based on this narrow mass defect window, background ions or interference ions can be largely filtered out. For example, if the drug molecule has mono-isotope mass at 500.030 Da and its metabolites have mass defects within 50 mDa of the drug's mass defect, the filter window will be 5 mDa to 55 mDa. Any ions whose mass defects fall within 5 mDa to 55 mDa are either the drug molecule or drug related metabolites, while the ions having mass defects beyond the window are filtered out. This mass defect filter is thus a very effective post data-processing procedure to detect metabolites in the presence of background ions from complex matrices.

This aspect of the invention integrates the mass defects approach into the data acquisition level, called mass defects dependent acquisition (MDDA). Instead of calculating intensities and signal to noise ratio in the conventional data dependent acquisition, MDDA computes mass defects of all the ions obtained from a full MS scan spectrum in real time (on-the-fly). Using the same example as above, a product ion scan will be performed on the ions that have met the pre-defined mass defects criteria of 5 mDa to 55 mDa. As a result, the LC/MS/MS chromatogram from MDDA shows only the peaks from a drug and its metabolites. This increases the throughput of metabolite identification by significantly reducing the burden of data processing and the need for repeated LC/MS experiments to perform MS/MS on ions missed in previous LC/MS experiments, when the valuable on-the-fly MS/MS time was spent on the wrong ions, including the matrix ions that may be more abundant than the true ions of interest.

Accurate Mass and Isotope Pattern Dependent MS/MS

To address the problem of non-specific criteria for MS/MS in the conventional data dependent acquisition and the drawback of mass defect dependent MS/MS where the satellite isotopes of other non-relevant ions have mass defects falling into the same window, this invention uses accurate mass measurement combined with isotope profile matching as conditions to prompt MS/MS scans. This will be illustrated by an example from the metabolic profiling applications. For a given drug molecule, a list of possible elemental compositions and exact masses of its metabolites can be found based on common known biotransformation. Similar to other data dependent acquisition, this accurate mass and isotope pattern recognition (AM/IPR) dependent acquisition acquires a full MS scan spectrum as the survey scan followed by calculating the accurate masses of each ion in the spectrum in real time (on-the-fly). With pre-defined mass accuracy, for example, 10 ppm, the ions having mass accuracy better than 10 ppm can be selected easily, by comparing the accurate masses of possible metabolites on the list. Due to potential interference from background ions or $C^{13}$ satellite peaks, the ions falling within the 10 ppm mass accuracy window may not be the drug-related metabolites. To remove possible false positives after this first pass, the second pass is implemented by matching isotope patterns of the ions within 10 ppm mass accuracy, against the theoretical isotope patterns calculated based on the elemental compositions on the list. These isotope pattern recognition (IPR) matching results are quantified by residuals indicating the difference between the measured and theoretical profiles, preferably using a regression procedure disclosed in U.S. provisional patent application Ser. No. 60/670,182, filed on Apr. 11, 2005 and U.S. patent application Ser. No. 11/402,238, filed on Apr. 10, 2006. If both the mass errors and the residuals are better than pre-set values, the data acquisition will switch to product ion scan, on-the-fly, for the MS/MS analysis of these ions. Again, what appears in the resulting LC/MS/MS chromatogram is nothing but the drug-related peaks, and all the ions in the MS/MS spectra are interference-free metabolite fragments.

Alternatively, the accurate mass and isotope profile dependent MS/MS can be triggered through a different algorithm than the one described in the preceding paragraph. The MS/MS can be triggered, on-the-fly, by what is outlined above (identification of a known ion from LC/MS scans) through the use of a projection matrix and residual or projected signal testing, on-the-fly.

The techniques described above may be used in a variety of instruments, and the embodiments of the invention are directed to such apparatus, as well as to a computer readable media having computer readable program instructions stored thereon, which when executed on a computer associated with one of such apparatus, will perform the methods described herein.

It is noted that the terms "mass" and "mass to charge ratio" are used somewhat interchangeably in connection with information or output as defined by the mass to charge ratio axis of a mass spectrometer. This is a common practice in the scientific literature and in scientific discussions, and no ambiguity will occur, when the terms are read in context, by one skilled in the art.

The methods of analysis of the present invention can be realized in hardware, software, or a combination of hardware and software. Any kind of computer system—or other apparatus adapted for carying out the methods and/or functions described herein—is suitable. A typical combination of hardware and software could be a general purpose computer system with a computer program that, when being loaded and executed, controls the computer system, which in turn control an analysis system, such that the system carries out the methods described herein. The present invention can also be embedded in a computer program product, which comprises all the features enabling the implementation of the methods described herein, and which—when loaded in a computer system (which in turn control an analysis system), is able to carry out these methods.

Computer program means or computer program in the present context include any expression, in any language, code or notation, of a set of instructions intended to cause a system having an information processing capability to perform a particular function either directly or after conversion to another language, code or notation, and/or reproduction in a different material form.

Thus the invention includes an article of manufacture, which comprises a computer usable medium having computer readable program code means embodied therein for causing a function described above. The computer readable program code means in the article of manufacture comprises computer readable program code means for causing a computer to effect the steps of a method of this invention. Similarly, the present invention may be implemented as a computer program product comprising a computer usable medium having computer readable program code means embodied therein for causing a function described above. The computer readable program code means in the computer program product comprising computer readable program code means for causing a computer to effect one or more functions of this invention. Furthermore, the present invention may be implemented as a program storage device readable by machine, tangibly embodying a program of instructions executable by the machine to perform method steps for causing one or more functions of this invention.

It is noted that the foregoing has outlined some of the more pertinent objects and embodiments of the present invention. The concepts of this invention may be used for many applications. Thus, although the description is made for particular arrangements and methods, the intent and concept of the invention is suitable and applicable to other arrangements and applications. It will be clear to those skilled in the art that other modifications to the disclosed embodiments can be effected without departing from the spirit and scope of the invention. The described embodiments ought to be construed to be merely illustrative of some of the more prominent features and applications of the invention. Thus, it should be understood that the foregoing description is only illustrative of the invention. Various alternatives and modifications can be devised by those skilled in the art without departing from the invention. Other beneficial results can be realized by applying the disclosed invention in a different manner or modifying the invention in ways known to those familiar with the art. Thus, it should be understood that the embodiments has been provided as an example and not as a limitation. Accordingly, the present invention is intended to embrace all alternatives, modifications and variances which fall within the scope of the appended claims.

What is claimed is:

1. A method of performing mass spectral analysis involving at least one of the isotope satellites of at least one ion, comprising:

acquiring a measured mass spectral response including at least one isotope;

constructing a peak component matrix with mass spectral response functions;

performing a regression analysis between the acquired mass spectral response and the peak component matrix; and reporting one of statistical measure and regression coefficients from the regression analysis for at least one of mass spectral peak purity assessment, ion charge determination, mass spectral deconvolution, and mass shift compensation.

2. The method of claim 1, further comprising defining desired mass spectral response functions.

3. The method of claim 2, where the desired mass spectral response function is a mass spectral peak shape function.

4. The method of claim 3, wherein the mass spectral peak shape function is one of assumed peak shape function, actual peak shape function, and target peak shape function.

5. The method of claim 4, wherein the mass spectral peak shape function is assumed peak shape function that approximates the actual peak shape function.

6. The method of claim 4, wherein the mass spectral peak shape function is actual peak shape function, and is one of calculated and measured peak shape function from a mass spectral scan.

7. The method of claim 4, wherein the mass spectral peak shape function is target peak shape function from a mass spectral calibration involving at least one of mass and peak shape.

8. The method of claim 2, wherein the desired mass spectral response function contains a convolution of isotope distribution and mass spectral peak shape function for at least one isotope of an ion.

9. The method of claim 8, where the isotope distribution is based on one of calculated theoretical distribution based on an elemental composition, and actually measured isotope distribution.

10. The method of claim 8, wherein the mass spectral peak shape function is one of assumed peak shape function, actual peak shape function, and target peak shape function.

11. The method of claim 10, wherein the mass spectral peak shape function is assumed peak shape function and approximates the actual peak shape function.

12. The method of claim 10, wherein the mass spectral peak shape function is actual peak shape function that is one of calculated and measured peak shape function from a mass spectral scan.

13. The method of claim 10, wherein the mass spectral peak shape function is target peak shape function and is based on a mass spectral calibration involving at least one of mass and peak shape.

14. The method of claim 1, wherein the peak component matrix contains at least one of desired mass spectral response function of at least one isotope of an ion, baseline components, derivative components, background components, and the desired mass spectral response functions of at least one isotope of an additional ion.

15. The method of claim 14, wherein the baseline components are at least one of linear and nonlinear in nature.

16. The method of claim 14, wherein the derivative components are first derivatives of at least one of acquired mass spectral response functions and desired mass spectral response of at least one isotope of one ion.

17. The method of claim 14, wherein the background components are taken from another mass spectral scan.

18. The method of claim 14, wherein the desired mass spectral response functions are one of theoretically calculated based on proposed elemental compositions and actually measured.

19. The method of claim 1, wherein the regression analysis is a weighted least squares regression.

20. The method of claim 19, wherein the weighted least squares regression is a linear regression which is one of univariate and multivariate.

21. The method of claim 19, wherein weights in the weighted least squares regression are inversely proportional to the mass spectral variances.

22. The method of claim 21, wherein mass spectral variances are proportional to mass spectral intensities.

23. The method of claim 1, wherein the regression coefficients contain concentration information for the ions of interest.

24. The method of claim 1, where the statistical measure is one of a t-statistic, F-statistic, $\chi^2$ statistic, and p-value.

25. The method of claim 1, where the statistical measure is used to indicate whether the acquired mass spectral response is from a single ion.

26. The method of claim 1, where the statistical measure is used to indicate possible charge states of one or more ions contained in the acquired mass spectral response.

27. The method of claim 1, where the acquired mass spectral response is calibrated for at least one of mass and peak shape.

28. The method of claim 1, where the mass spectral response is a plasmagram acquired on an ion mobility spectrometer (IMS).

29. A computer programmed to perform the method of claim 1.

30. The computer of claim 29, in combination with a mass spectrometer for obtaining mass spectral data to be analyzed by said computer.

31. A computer readable medium having computer readable code thereon for causing a computer to perform the method of claim 1.

32. A mass spectrometer having associated therewith a computer for performing data analysis functions of data produced by the mass spectrometer, the computer performing the method of claim 1.

33. A method for the identification of an ion in a MS scan, comprising:

obtaining at least one isotope pattern of an ion;

acquiring at least one MS scan covering a mass range of interest;

constructing a projection matrix based on one of the isotope pattern and the MS scan;

projecting one of the isotope pattern and MS scan onto the projection matrix to calculate at least one of projection residual and projected data; and performing a statistical test on at least one of the projection residual and projected data to determine one of if the ion exists in a sample and if the acquired MS scan contains an interference.

34. The method of claim 33, wherein the isotope pattern is calculated by steps comprising:

one of calculating isotope distribution for a given ion of interest based on elemental composition and measuring isotope distribution for a given ion of interest; and convoluting the isotope distribution with one of assumed peak shape function, actual peak shape function, and target peak shape function to form said isotope pattern.

35. The method of claim 34, wherein assumed peak shape function is used for convolution, and the assumed peak shape function approximates the true peak shape function.

36. The method of claim 34, wherein the actual peak shape function is used for convolution, and is one of actually measured and calculated, from mass spectral scan data.

37. The method of claim 34, wherein target peak shape function is used for convolution and is based on a mass spectral calibration involving at least one of mass and peak shape.

38. The method of claim 33, where the isotope pattern is an actually measured isotope profile of an ion.

39. The method of claim 38, where the actually measured isotope profile of an ion is calibrated for at least one of mass and peak shape.

40. The method of claim 33, further comprising:

applying a weighting scheme based on a projection statistical measure to filter an extracted ion chromatogram in order to enhance signals relevant to an ion of interest and suppress signals not relevant to the ion of interest.

41. The method of claim 40, wherein the extracted ion chromatogram used for filtering is based on one of summed mass spectral intensities within a mass range and fitted quantities using the isotope pattern for the ion of interest.

42. The method of claim 40, wherein the projection statistical measure is one of a t-statistic, F-statistic, $\chi^2$ statistic, and p-value.

43. The method of claim 33, where the projection matrix is calculated based on Singular Value Decomposition (SVD) of a submatrix composed of at least one MS scan.

44. The method of claim 33, further comprising plotting the projected data against MS scan time to obtain an extracted ion chromatogram with reduced interference.

45. The method of claim 33, further comprising using a front end separation step; and conducting multiple mass spectral scans corresponding to multiple time points of said front end separation step.

46. The method of claim 33, further comprising a front end separation step that includes a chromatographic separation.

47. The method of claim 46, where the chromatographic separation is one of liquid chromatography (LC) and gas chromatography (GC).

48. The method of claim 33, where the statistical test is based on one of a t-statistic, F-statistic, $\chi^2$ statistic, and p-value.

49. The method of claim 33, wherein a given ion of interest is a defined mixture of ions with known elemental compositions.

50. The method of claim 49, where the mixture is defined by concentration ratios of ions contained therein.

51. The method of claim 49, where the ions include native and isotope labeled version of the same ion.

52. The method of claim 33, where the acquired MS scan is calibrated for at least one of mass and peak shape.

53. The method of claim 33, where the mass spectral response is a plasmagram acquired on an ion mobility spectrometer (IMS).

54. A computer programmed to perform the method of claim 33.

55. The computer of claim 54, in combination with a mass spectrometer for obtaining mass spectral data to be analyzed by said computer.

56. A computer readable medium having computer readable code thereon for causing a computer to perform the method of claim 33.

57. A method for integrating mass defects detection into mass spectral data acquisition, comprising:

specifying a mass defect criterion based on mass defects for ions of interest;

acquiring a full mass spectral scan;

computing mass defects of all ions in the full mass spectral scan; and performing an MS/MS experiment on the ions that have met a pre-defined mass defect criterion.

58. The method of claim 57, wherein the mass defect is computed by accurate mass measurement of all ions from a full MS scan.

59. The method of claim 58, wherein the accurate mass measurement is achieved on a mass spectrometer of resolving power higher than unit mass resolution.

60. The method of claim 58, wherein the accurate mass measurement is achieved on a mass spectrometer of substantially unit mass resolution through a mass spectral calibration involving at least one of mass and peak shape.

61. The method of claim 57, wherein the computing step is carried out in real time during an active data acquisition process on a mass spectrometer.

62. A computer programmed to perform the method of claim 57.

63. The computer of claim 62, in combination with a mass spectrometer for obtaining mass spectral data to be analyzed by said computer.

64. A computer readable medium having computer readable code thereon for causing a computer to perform the method of claim 57.

65. A mass spectrometer having associated therewith a computer for performing data analysis functions of data produced by the mass spectrometer, the computer performing the method of claim 57.

66. A method for performing mass and isotope pattern dependent MS/MS, comprising:

defining a list of possible ions including their elemental compositions;

calculating theoretical isotope distributions for ions in the list;

convoluting the theoretical isotope distributions with one of assumed peak shape function, actual peak shape function, and target peak shape function to form theoretical isotope patterns;

acquiring a full mass spectral scan in profile mode;

analyzing the full mass spectral scan for both masses and isotope patterns; and identifying ions with the correct masses and matching isotope patterns for MS/MS analysis.

67. The method of claim 66, where the analyzing and identifying can be accomplished through a regression analysis between the theoretical isotope patterns and measured isotope patterns in the acquired full mass spectral scan in profile mode.

68. The method of claim 66, where the analyzing and identifying can be accomplished through a projection operation involving the theoretical isotope patterns and the acquired full mass spectral scan in profile mode.

69. The method of claim 66, further comprising calibrating the acquired full mass spectral scan in profile mode using a calibration involving at least one of mass and peak shape.

70. The method of claim 66, wherein assumed peak shape function is used for convolution and approximates the true peak shape function.

71. The method of claim 66, wherein the actual peak shape function is used for convolution and is one of actually measured and calculated from mass spectral scan data.

72. The method of claim 66, wherein target peak shape function is used for convolution and is based on a mass spectral calibration involving at least one of mass and peak shape.

73. The method of claim 66, where the each ion in the list is one of a defined mixture of ions with known elemental compositions.

74. The method of claim 73, where the mixture is defined by concentration ratios of the ions.

75. The method of claim 66, where the ions include native and isotope labeled version of the same ion.

76. The method of claim 66, where the acquiring, analyzing, and identifying are carried out in real time during an active data acquisition process on a mass spectrometer.

77. A computer programmed to perform the method of claim 66.

78. The computer of claim 77, in combination with a mass spectrometer for obtaining mass spectral data to be analyzed by said computer.

79. A computer readable medium having computer readable code thereon for causing a computer to perform the method of claim 66.

80. A mass spectrometer having associated therewith a computer for performing data analysis functions of data produced by the mass spectrometer, the computer performing the method of claim 66.

81. A method of performing mass spectral analysis in the presence of mass shift involving at least one of the isotope satellites of at least one ion, comprising:

acquiring a measured mass spectral response including at least one isotope;

obtaining a desired mass spectral response including at least one isotope;

comparing the measured mass spectral response and the desired mass spectral response and calculating a goodness-of-fit measure and relative concentration between the measured and desired mass spectral response;

repeating the comparing step by shifting one of the measured and desired mass spectral response to seek an optimal mass shift that provides the best goodness-of-fit measure; and using at least one of the optimal mass shift, the corresponding goodness-of-fit, and the relative concentration for one of quantitative and qualitative analysis.

82. The method of claim 81, wherein the desired mass spectral response function contains a convolution of isotope distribution and mass spectral peak shape function for at least one isotope of an ion.

83. The method of claim 82, where the isotope distribution is based on one of calculated theoretical distribution based on an elemental composition, and actually measured isotope distribution.

84. The method of claim 82, wherein the mass spectral peak shape function is one of assumed peak shape function, actual peak shape function, and target peak shape function.

85. The method of claim 84, wherein the mass spectral peak shape function is assumed peak shape function and approximates the actual peak shape function.

86. The method of claim 84, wherein the mass spectral peak shape function is actual peak shape function that is one of calculated and measured peak shape function from a mass spectral scan.

87. The method of claim 84, wherein the mass spectral peak shape function is target peak shape function and is based on a mass spectral calibration involving at least one of mass and peak shape.

88. A computer programmed to perform the method of claim 81.

89. The computer of claim 88, in combination with a mass spectrometer for obtaining mass spectral data to be analyzed by said computer.

90. A computer readable medium having computer readable code thereon for causing a computer to perform the method of claim 81.

91. A mass spectrometer having associated therewith a computer for performing data analysis functions of data produced by the mass spectrometer, the computer performing the method of claim 81.

* * * * *